US009149135B2

(12) United States Patent
Dovell

(10) Patent No.: US 9,149,135 B2
(45) Date of Patent: Oct. 6, 2015

(54) PORTABLE BOTTLE RACK

(71) Applicant: Amy Dovell, Las Vegas, NV (US)

(72) Inventor: Amy Dovell, Las Vegas, NV (US)

( * ) Notice: Subject to any disclaimer, the term of this patent is extended or adjusted under 35 U.S.C. 154(b) by 0 days.

(21) Appl. No.: 14/269,752

(22) Filed: May 5, 2014

(65) Prior Publication Data

US 2014/0239022 A1 Aug. 28, 2014

Related U.S. Application Data

(63) Continuation-in-part of application No. 13/400,201, filed on Feb. 20, 2012, now Pat. No. 8,777,019.

(60) Provisional application No. 61/463,647, filed on Feb. 22, 2011.

(51) Int. Cl.
*A47B 73/00* (2006.01)
*A47F 7/00* (2006.01)
(Continued)

(52) U.S. Cl.
CPC . *A47F 7/283* (2013.01); *A45C 3/04* (2013.01); *A45C 11/20* (2013.01); *A45C 13/02* (2013.01); *A45C 13/26* (2013.01); *A47B 73/00* (2013.01);
(Continued)

(58) Field of Classification Search
CPC .... A47B 73/00; A47B 81/007; A47B 73/006; A47B 73/008; A47B 73/002; A47F 7/283; A47F 7/281; A47F 7/28; A47F 3/18; A47F 5/02; A47J 47/16; A47G 23/02; A47G 23/0241; A47G 23/0266; B01L 9/06; B65D 85/305; B65D 25/28; B65D 23/00; B65D 23/10; B65D 23/102; B65D 23/104; B65D 1/02; B65D 25/2835; B65D 25/2838; B65D 1/12; B65D 1/14; B65D 1/16; B65D 25/2844; B65D 25/2852; B65D 5/46; B65D 5/46008; B65D 5/46072; B65D 25/1861; B65D 25/2882; B65D 71/003; B65D 71/50; B65D 71/011; B65D 25/2879; B65D 71/504; B65D 83/305; B65D 71/0018; B65D 71/0025; B65D 5/22; B65D 7/26; B65D 5/46024; B65D 71/08; B65D 71/246; B65D 71/004; B65D 21/0213; B65D 1/243; B65D 71/0059; B65D 71/0074; B65D 71/0081; B65D 7/007; B65D 71/0055; A45C 11/20; A45C 13/02; A45C 2200/20; A45C 3/04; A45C 13/26
USPC ..... 211/74, 75, 49.1, 194, 183, 85.18, 175, 211/13.1; 206/141, 142, 163, 164, 166; 220/503, 507, 759, 760, 761, 763, 769, 220/770, 722
See application file for complete search history.

(56) References Cited

U.S. PATENT DOCUMENTS 112,955 A * 3/1871 Pinckney ..... 206/142
2,256,451 A * 9/1941 Hamilton ..... 206/142
(Continued)

*Primary Examiner* — Jennifer E Novosad
(74) *Attorney, Agent, or Firm* — Christine Flanagan

(57) ABSTRACT

The portable beverage rack of the present invention is a generally square or rectangular receptacle which may safely store one or more bottles in u-shaped channels which cradle the bottles and prevent movement of the bottles while in transit or while travelling on a boat or RV. The u-shaped channels may contain a rubber pad on the inside surface to prevent sliding, rolling, or other lateral movement of the bottles. The portable beverage rack also contains a securement mechanism, such as a strap, buckle or band which extends over the top of the bottles to prevent vertical movement of the bottles. Additionally, the rack includes means to attach the rack to a wall or other vertical surface using a separate wall mounted base plate.

20 Claims, 8 Drawing Sheets

(51) Int. Cl.

| | |
|---|---|
| ***A47F 7/28*** | (2006.01) |
| ***B65D 71/52*** | (2006.01) |
| ***B65D 71/54*** | (2006.01) |
| ***B65D 25/28*** | (2006.01) |
| ***A45C 11/20*** | (2006.01) |
| ***A45C 13/02*** | (2006.01) |
| ***A45C 3/04*** | (2006.01) |
| ***A45C 13/26*** | (2006.01) |

(52) U.S. Cl.
CPC ..... *A47B 73/008* (2013.01); *A47F 7/281* (2013.01); *A45C 2200/20* (2013.01)

(56) References Cited

U.S. PATENT DOCUMENTS

| | | | | | |
|---|---|---|---|---|---|
| 2,259,667 | A | * | 10/1941 | Smith | 206/142 |
| 2,329,656 | A | * | 9/1943 | Sedgwick | 206/427 |
| 2,333,757 | A | * | 11/1943 | Whitaker | 206/142 |
| 2,353,846 | A | * | 7/1944 | Power | 220/6 |
| 2,395,601 | A | * | 2/1946 | Wenthe | 206/163 |
| 2,396,003 | A | * | 3/1946 | Goldman | 220/511 |
| 2,399,893 | A | * | 5/1946 | Scholz | 206/142 |
| 2,404,699 | A | * | 7/1946 | Edgerton | 206/174 |
| 2,414,708 | A | * | 1/1947 | Bassichis | 206/174 |
| 2,419,413 | A | * | 4/1947 | McCalla | 206/142 |
| 2,420,006 | A | * | 5/1947 | O'Hare | 206/163 |
| 2,425,401 | A | * | 8/1947 | Shaw et al. | 206/201 |
| 2,431,713 | A | * | 12/1947 | Stigler | 206/163 |
| 2,443,967 | A | * | 6/1948 | Smith | 206/163 |
| 2,458,133 | A | * | 1/1949 | Behrens | 206/164 |
| 2,467,106 | A | * | 4/1949 | Adkins | 206/168 |
| 2,494,303 | A | * | 1/1950 | McGuire | 206/435 |
| 2,502,690 | A | * | 4/1950 | Acton | 206/163 |
| 2,503,544 | A | * | 4/1950 | Clore | 206/435 |
| 2,508,062 | A | * | 5/1950 | Fowler | 206/142 |
| 2,508,943 | A | * | 5/1950 | Hall et al. | 206/164 |
| 2,522,978 | A | * | 9/1950 | Acton | 206/163 |
| 2,525,633 | A | * | 10/1950 | Arnett | 206/163 |
| 2,531,092 | A | * | 11/1950 | Waller | 206/435 |
| 2,532,446 | A | * | 12/1950 | Hall | 206/190 |
| 2,535,113 | A | * | 12/1950 | Acton | 206/199 |
| 2,540,068 | A | * | 1/1951 | Williamson | 16/443 |
| 2,542,365 | A | * | 2/1951 | Schumann | 206/164 |
| 2,552,361 | A | * | 5/1951 | Acton | 206/164 |
| 2,593,861 | A | * | 4/1952 | Eder et al. | 220/516 |
| 2,603,377 | A | * | 7/1952 | Mayers et al. | 217/19 |
| 2,606,703 | A | * | 8/1952 | Olson | 206/164 |
| 2,624,498 | A | * | 1/1953 | Lamprecht | 206/164 |
| 2,632,595 | A | * | 3/1953 | Finkbone | 229/117.22 |
| 2,667,995 | A | * | 2/1954 | Bruce et al. | 206/160 |
| 2,682,972 | A | * | 7/1954 | Ringler | 206/164 |
| 2,731,169 | A | * | 1/1956 | Wahlbom | 206/196 |
| 2,916,185 | A | * | 12/1959 | Skulavik | 206/174 |
| 2,954,899 | A | * | 10/1960 | Skulavik | 206/174 |
| 2,997,169 | A | * | 8/1961 | Poupitch | 206/150 |
| 3,016,136 | A | * | 1/1962 | Poupitch | 206/527 |
| 3,261,498 | A | * | 7/1966 | Erickson | 206/164 |
| 3,362,577 | A | * | 1/1968 | Singer et al. | 206/164 |
| 3,531,014 | A | * | 9/1970 | Lane | 206/203 |
| D222,151 | S | * | 10/1971 | Majewski | D7/701 |
| D233,878 | S | * | 12/1974 | Berger et al. | D7/600.4 |
| 3,951,259 | A | * | 4/1976 | Oglesbee | 206/164 |
| 3,966,103 | A | * | 6/1976 | Abrams | 294/144 |
| 4,093,076 | A | * | 6/1978 | Newton | 211/74 |
| 4,494,788 | A | * | 1/1985 | Altemose | 294/161 |
| 4,884,683 | A | * | 12/1989 | Ford | 206/163 |
| 5,078,155 | A | * | 1/1992 | Grandel | 131/231 |
| 5,150,784 | A | * | 9/1992 | Sayad | 206/202 |
| 6,135,297 | A | * | 10/2000 | DeShazo et al. | 211/74 |
| 6,290,074 | B1 | * | 9/2001 | Syvuk et al. | 211/74 |
| 6,615,996 | B1 | * | 9/2003 | Ivey | 211/74 |
| 6,769,659 | B1 | * | 8/2004 | Martello | 248/311.2 |
| 6,811,042 | B2 | * | 11/2004 | Kelly et al. | 211/74 |
| 7,048,130 | B2 | * | 5/2006 | Hurst | 211/74 |
| 8,777,019 | B2 | * | 7/2014 | Dovell | 211/74 |
| 2001/0025824 | A1 | * | 10/2001 | Olivero | 211/74 |
| 2002/0036178 | A1 | * | 3/2002 | Tombu | 211/74 |
| 2006/0261019 | A1 | * | 11/2006 | Chao et al. | 211/74 |
| 2007/0108144 | A1 | * | 5/2007 | Flick | 211/74 |
| 2011/0132853 | A1 | * | 6/2011 | Drobot et al. | 211/42 |

* cited by examiner

PORTABLE BOTTLE RACK

RELATED APPLICATIONS

This application is a continuation-in-part of U.S. patent application Ser. No. 13/400,201, filed on Feb. 20, 2012 which claims priority to U.S. Provisional Patent Application No. 61/463,647, filed on Feb. 22, 2011, which is incorporated herein by reference in its entirety.

FIELD OF THE INVENTION

The present invention is directed to a portable rack for securely holding breakable beverage bottles.

BACKGROUND OF THE INVENTION

Beverage bottles, such as wine bottles are typically carried in a paper bag or other shopping bag. However, due to the fragile nature of the glass and the potential for having to transport two or more bottles, these transport modes are unsafe. Two or more wine bottles become difficult to safely transport from one location to another considering the weight and breakability of glass bottles. It is fairly common for one to take or transport wine or other beverages to a party, on a trip or while travelling in an RV, boat or other moving vehicle.

Various wine carriers are known in the art. These carriers are generally wire framed baskets which hold the bottles in an upright position or wooden carriers with little or no protection. Also, once the carrier has reached its destination, placing such carriers on the table or floor is not ideal when travelling in moving vehicles such as RVs or boats. The bottles may vibrate against one another or may roll or otherwise move, coming in contact with other bottles or inflexible items.

There is a need in the art for a safe and secure device for transporting wine from one place to another and also for storing the bottles while travelling in a moving vehicle such as an RV or a boat.

SUMMARY OF THE INVENTION

The portable beverage rack of the present invention is a generally square or rectangular receptacle which may safely store one or more bottles in u-shaped channels which cradle the bottles and prevent movement of the bottles while in transit or while travelling on a boat or an RV. The u-shaped channels may contain a rubber pad on the inside surface to prevent sliding, rolling or other lateral movement of the bottles. The portable beverage rack also contains a securement mechanism, such as a strap, buckle or band which extends over the top of the bottles to prevent vertical movement of the bottles. Additionally, the rack includes means to attach the rack to a wall or other vertical surface using a separate wall mounted base plate.

DETAILED DESCRIPTION OF PREFERRED AND ALTERNATE EMBODIMENTS

Figure 1:
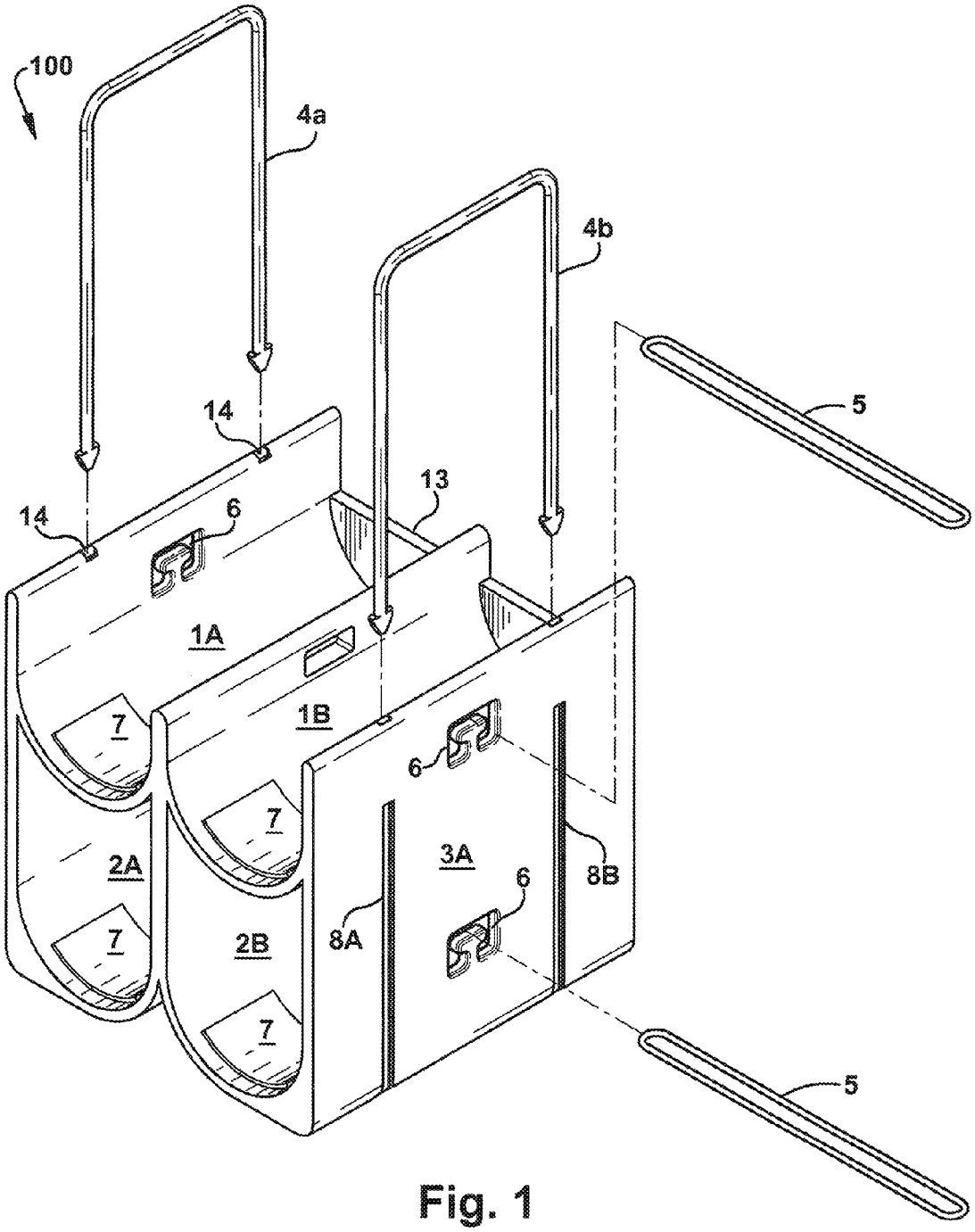
FIG. 1 is an exploded perspective view of the portable wine rack of the present invention.

The portable wine or beverage rack (hereinafter referred to interchangeably as "rack"; "wine rack"; "portable wine rack"; "beverage rack") of the present disclosure and related inventions is a novel storage and transport mechanism which provides for the safe and secure movement of wine or other such glass beverage bottles form one location to another. As used herein, the term "bottle" refers generally to a standard size wine or champagne bottle, generally having a width ranging from approximately 2⅜-inches to approximately 4-inches. However, the portable beverage or bottle rack may be made to fit specific or specially sized bottles.

In a preferred embodiment as described herein and shown in the figures, the portable wine rack 100 can accommodate up to four bottles, two bottles located in an adjacent manner on a first tier and two bottles located in an adjacent manner on a second tier. The second tier is vertically spaced apart from and located directly above the first tier. Each tier contains two u-shaped channels which each hold or cradle a single bottle placed on its side in a horizontal manner. The two u-shaped channels 1A, 1B on the first or bottom tier contain side walls that extend vertically upward and are contiguous with the two u-shaped channels 2A, 2B on the second or top tier. The two u-shaped channels 2A, 2B on the second or top tier continue to extend vertically upward, reaching a point above the top of a horizontally placed bottle as placed within a channel. The right 3A and left 3B side walls of the rack 100 are substantially planar but may, in certain embodiments, contain slots or openings thereon to facilitate securement of the bottles to the rack 100 via an attachment mechanism. The right 3A and left 3B side walls of the rack 100 may also contain openings thereon to facilitate attachment of the entire rack to a wall or other vertical surface, as discussed in detail below. In one embodiment, the left and right sides of the rack may also contain hollowed elongate openings 8A, 8B into which retractable handles 4A, 4B may be stored. Otherwise, the handles may be simply attached to the top of both the right 3A and left 3B side walls of the rack 100 such that they may be moved towards one another to facilitate a user gripping both handles 4A, 4B in one hand for pick-up and/or transport. The back or rear face 13 of the rack 100 is also substantially planar but may contain, as discussed above with respect to the right 3A and left 3B walls of the rack 100, optional slots or openings thereon to accommodate attachment of the rack 100 to a separate wall mount plate 10 for securing the rack 100 to a wall or other vertical surface. The front face of the rack is substantially open to accommodate bottles in a side or horizontal position with the top or neck of the bottle or bottles extending outward. The rack 100 is preferably made of molded plastic, but other suitable materials may be used. Each of the u-shaped channels 1A, 1B, 2A, 2B may contain a sheet of adhesive backed rubber 7 to create a friction grip on each of the bottles placed therein to prevent movement or sliding of the bottles along the channel when the rack 100 is in motion. While the portable wine rack 100 has been described herein and shown in the figures as accommodating four bottles, nothing in this disclosure is meant to limit the invention in any way and a wider or taller rack which may accommodate more than four bottles or a smaller rack which may accommodate less than four bottles has been contemplated and is considered to be within the scope of this invention.

Figure 2:
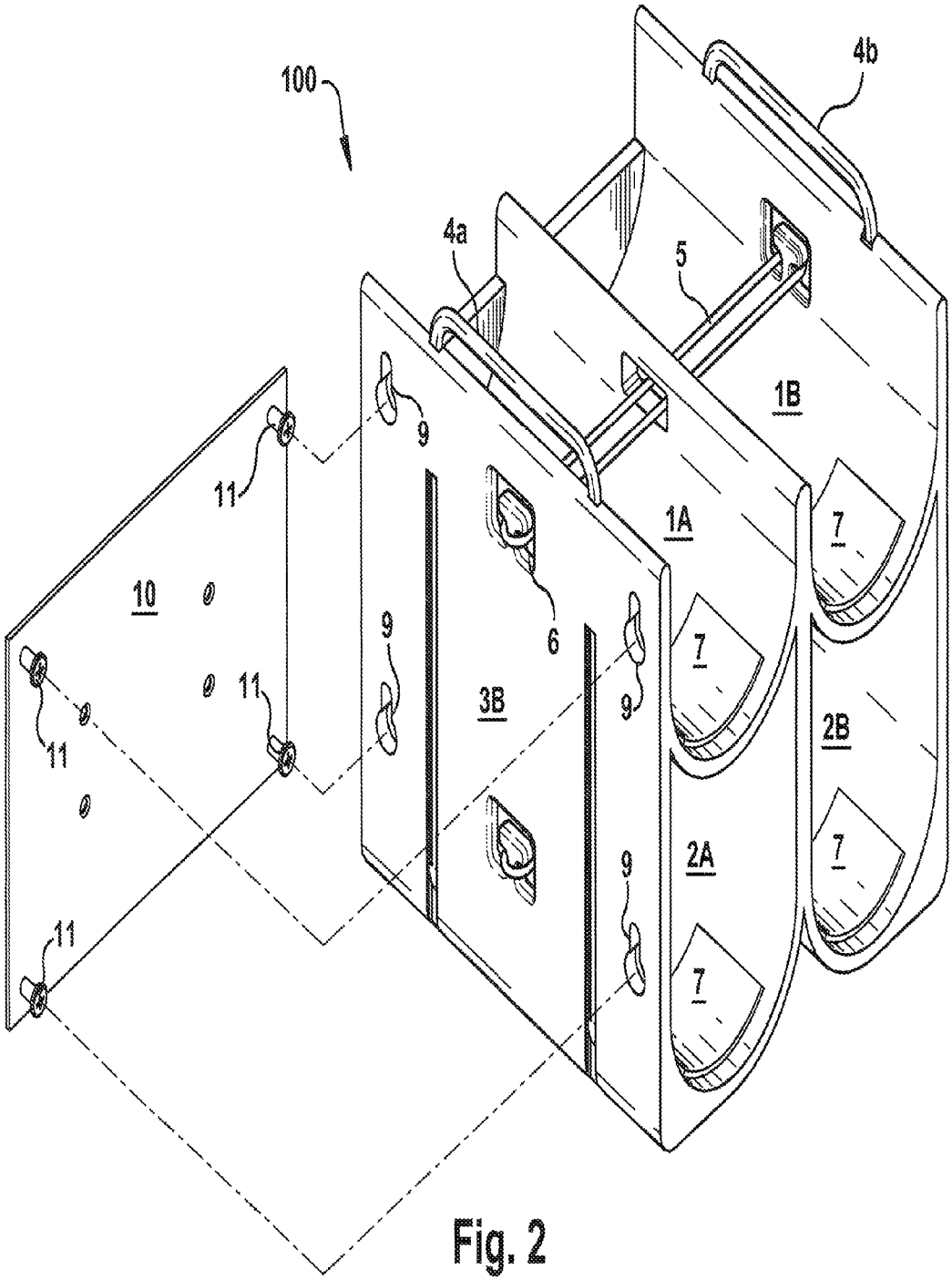
FIG. 2 is a perspective view of the portable wine rack and wall mounted base plate.
Figure 3:
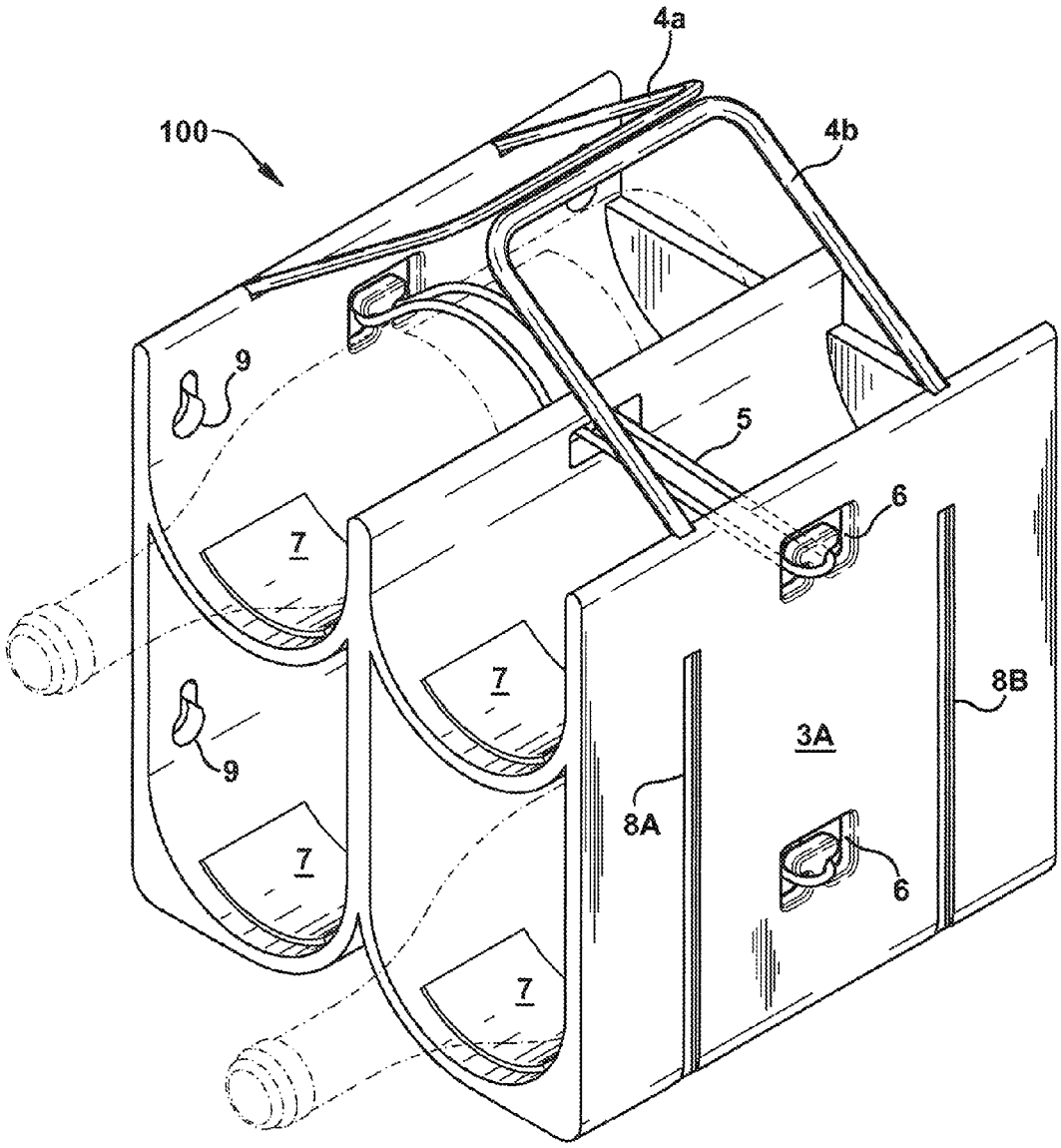
FIG. 3 is a perspective view of the portable wine rack with protracted handles and rubber band securement mechanism.
Figure 4:
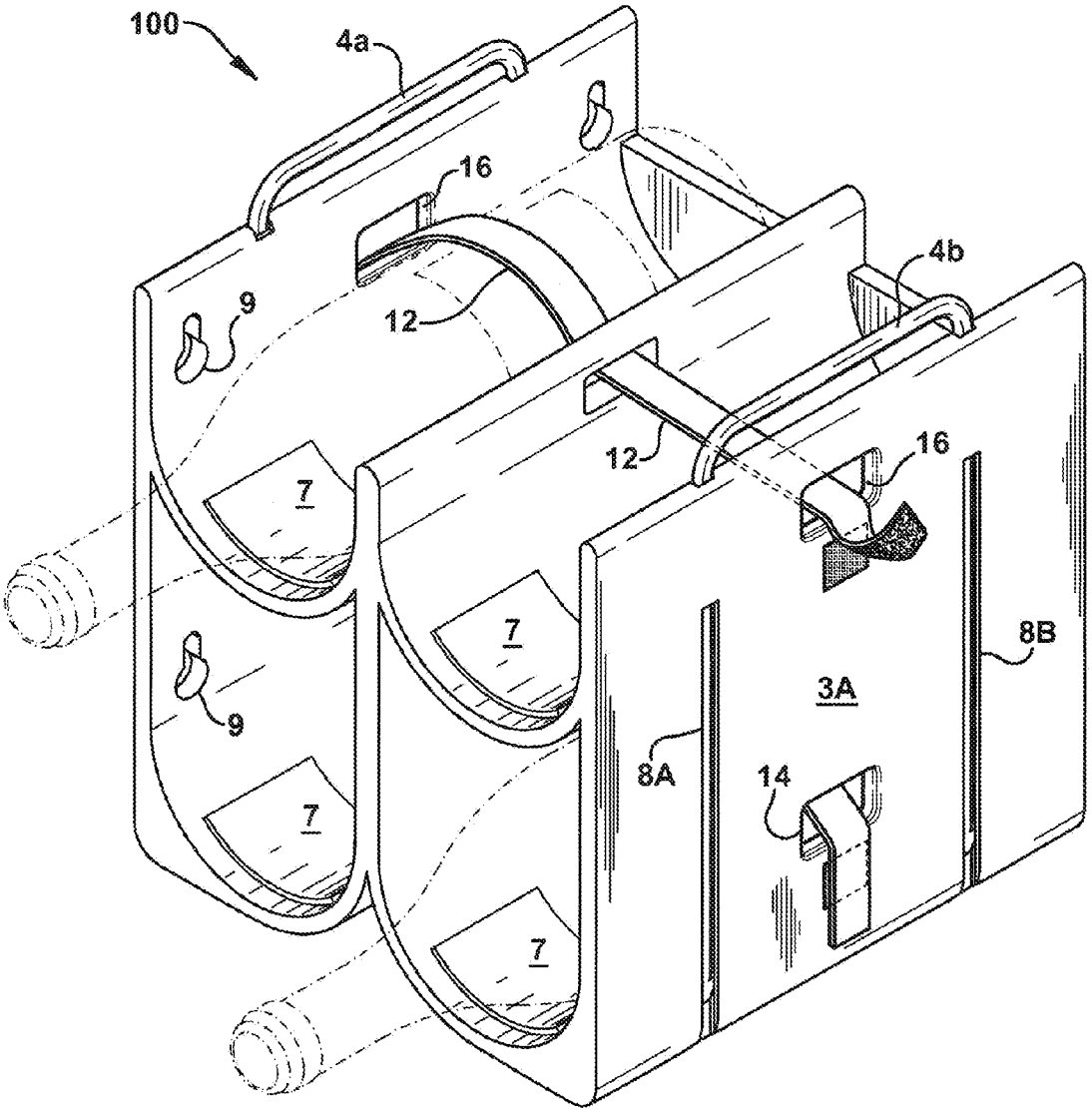
FIG. 4 is a perspective view of the portable wine rack with retracted handles and Velcro™ strip securement mechanism.

The rack 100 contains one or more securement mechanism which are operative to securely hold the bottles in place within each of the u-shaped channels 1A, 1B, 2A, 2B. As used herein the term "securement mechanism" refers to any device which secures a bottle to the portable bottle rack. The securement mechanism can take a variety of forms. In one embodiment, shown in FIG. 3, one or more rubber bands 5 may be used to secure the bottles within the rack 100. The rubber band 5 may be stretched from the right side wall 3A of the rack 100 to the left side wall 3B of the rack 100 slightly above or directly on top of the bottles contain in the two adjacent u-shaped channels 1A, 1B, 2A, 2B on each of the two tiers of the rack 100. The right 3A and left 3B side walls of the rack 100 may contain openings 6 thereon with t-cleats (as shown in FIGS. 1-3) to secure each side of the rubber band 5 in place across the top surface of the horizontally placed bottles. Other such mechanisms can be used in place of the t-cleats to hold the rubber bands 5 in place. At least one rubber band 5 may be used across the first or bottom tier and at least one rubber band 5 may be used across the second or upper tier. Alternately, in another embodiment, shown in FIG. 4, a band or strip of material 12 may extend across each tier above the bottles placed in the u-shaped channels 1A, 1B, 2A, 2B, the material having a reinforced loop patch (such as a Velcro™ loop patch) sewn or otherwise attached to the bottom or downward facing surface thereof. The material 12 may extend from the right side 3A to the left side 3B of the rack 100 and beyond. A small hook patch (such as a Velcro™ hook patch) 15 may be attached, adhesively or otherwise, to the outer surface of the right 3A and left 3B sides of the rack 100. At least one band or strip of material 12 with the loop patch extends across each tier with each of the distal ends inserted into openings 16 on the right 3A and left 3B side walls of the rack 100 and attached to the hook patch 15 such that the band or strip of material 12 is held taut across the top surface of the bottles lying horizontally within each u-shaped channel 1A, 1B, 2A, 2B. In still another embodiment, two straps may be attached to the top of opposite sides of each u-shaped channel. One of the straps may contain a buckle, a button, a snap or other such attachment mechanism to secure one strap to the other opposite strap to secure each bottle into each of the u-shaped channels. While the securement mechanisms described herein and shown in the figures are straps or rubber bands, any other type of securement mechanism may be used and other mechanisms have been contemplated and are considered to be within the scope of this invention.

As mentioned above, the portable wine rack 100 of the present invention contains one or more handles which are used to pick-up and carry or transport the rack. Various types of handles may be used with the present invention. In a preferred embodiment, one inverted u-shaped handle 4 is attached or inserted into the right 3A and the left 3B side walls of the wine rack 100. The distal ends of each handle are shaped like an arrow head so that once the handles are inserted into the sides 3A, 3B of the wine rack 100, they cannot be completely removed therefrom. Two hollow channels or cavities 8A, 8B exist in each of the right 3A and left 3B side walls of the rack 100, to accommodate each leg of the handle 4. The legs of each handle 4 may have a longer length than that of the wine rack 100, such that when the handle 4 is in a resting position, with each leg substantially within the right 3A and left 3B side walls of the rack 100, the handle 4 extends above the rack 100, as shown in FIG. 2, for easy gripping of each handle 4. Once a user is ready to pick-up or carry the rack 100, each handle 4 may be lifted out from the side walls 3A, 3B of the rack 100. Each handle 4 extends upward until the two arrow head ends of each leg of each handle 4 are reached. The openings 14 atop each of the right 3A and left 3B side walls of the wine rack 100 are angled such that each handle 4 may come together in an A-shape where the tops or the gripping portion of each handle 4 are in contact with one another, as shown in FIG. 3. In an alternate embodiment, the handles may not retract or slide back into the channels in the side walls of the rack but may simply be attached to the top surface of the right 3A and left 3B side walls. The handles 4 may be made of plastic, metal, wood, or any other suitable material. While a single handle 4 has been described herein and shown in the figures as being located on each of the right 3A and left 3B side walls of the rack 100, any number of handles may be used and various positions and locations for the handles 4 have been contemplated and are considered to be within the scope of this invention.

The entire portable wine rack 100 of the present invention may be attached to a wall or other vertical structure, such as a boat or an RV, to secure the structure while in motion. As mentioned above, one side 3A or 3B of the rack 100 may contain openings 9 thereon which facilitate attachment of the rack 100 to a wall mounted base plate 10, as shown in FIG. 2. The wall mounted base plate 10 is a substantially planar sheet having various apertures or holes contained thereon. In a preferred embodiment, threaded apertures or holes are contained proximate to each corner of the square or rectangular shaped base plate 10. Screws 11 are inserted into the threaded holes and extend in an outward direction to facilitate attachment of the wine rack 100 thereto. One side, right 3A or left 3B, of the wine rack 100 contains four apertures or holes 9 which correspond to the location of the four screws 11 contains on the base plate 10. The apertures or holes 9 contained on the rack 100 may be pear shaped, as shown in FIG. 2, for easy attachment and removal of the rack 100 from the base plate 10 and to further secure the rack 100 to the base plate 10 when attached. The base plate 10 may be made of metal, wood, plastic, or any other suitable material.

Figure 5:
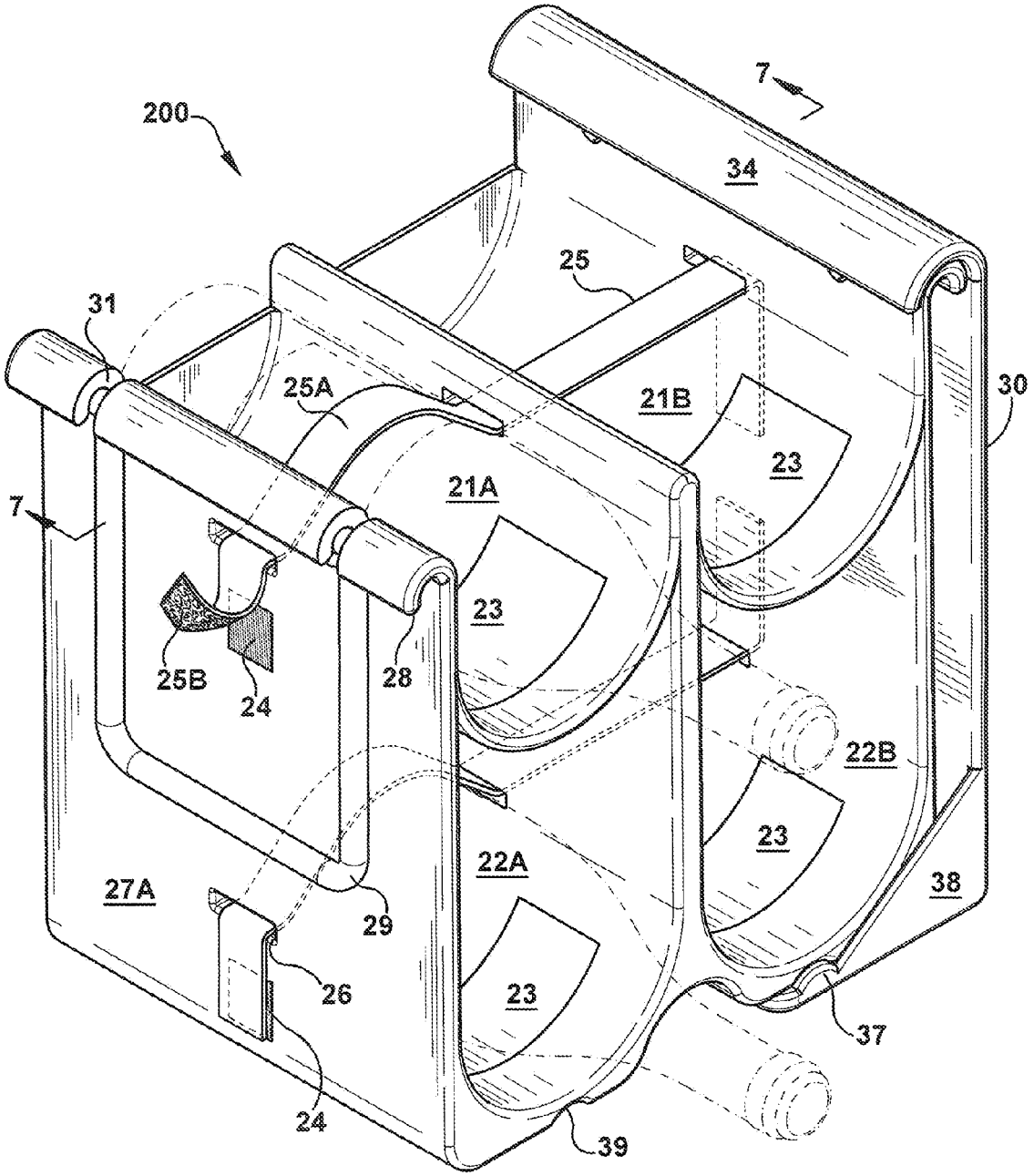
FIG. 5 is a perspective view of an alternate embodiment of the portable wine rack of the present invention, inserted into a wall mounted plate.
Figure 6:
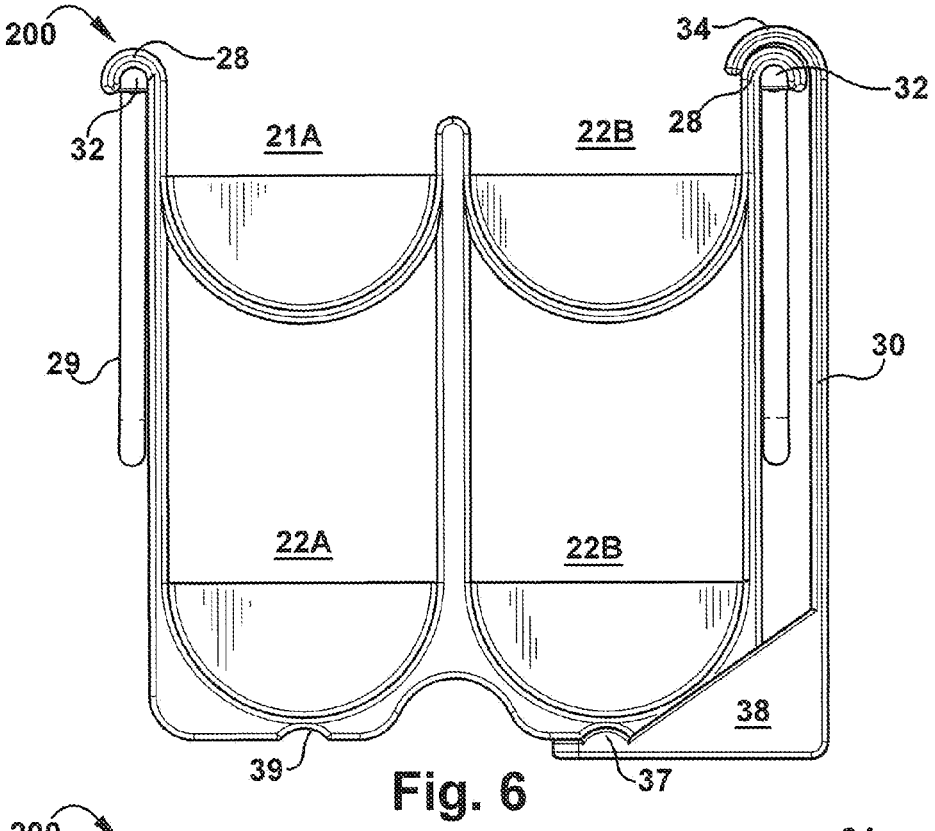
FIG. 6 is a right side view of the portable wine rack of FIG. 5.
Figure 7:
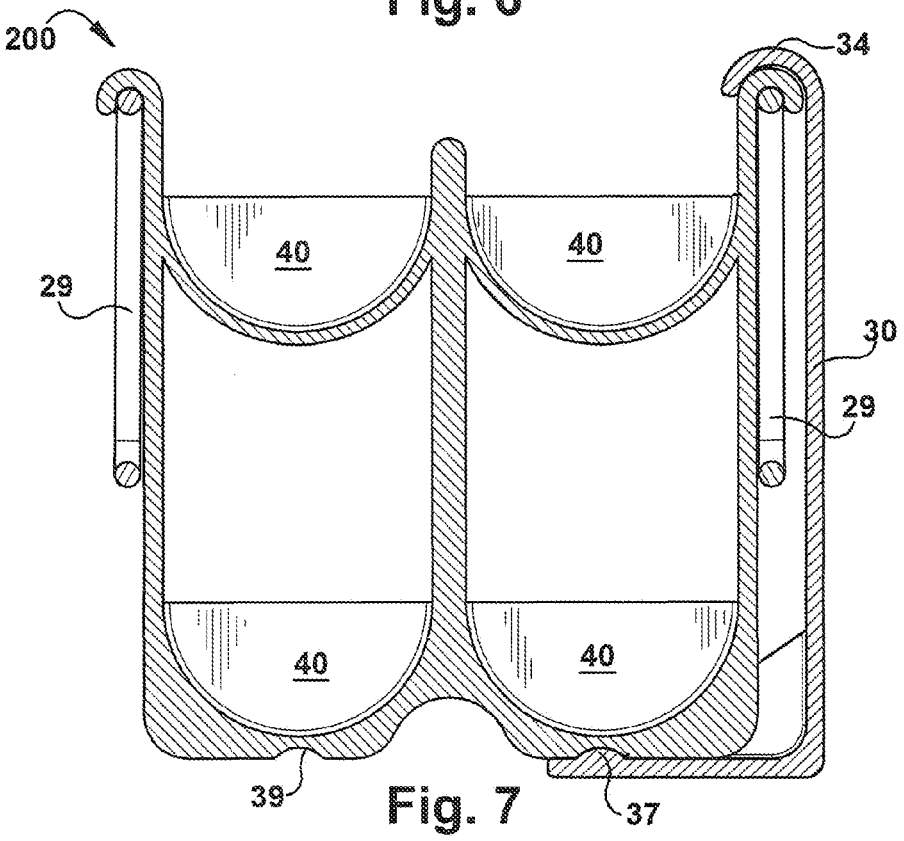
FIG. 7 is a cross-sectional view of FIG. 5, from the perspective of arrows 7-7.
Figure 8:
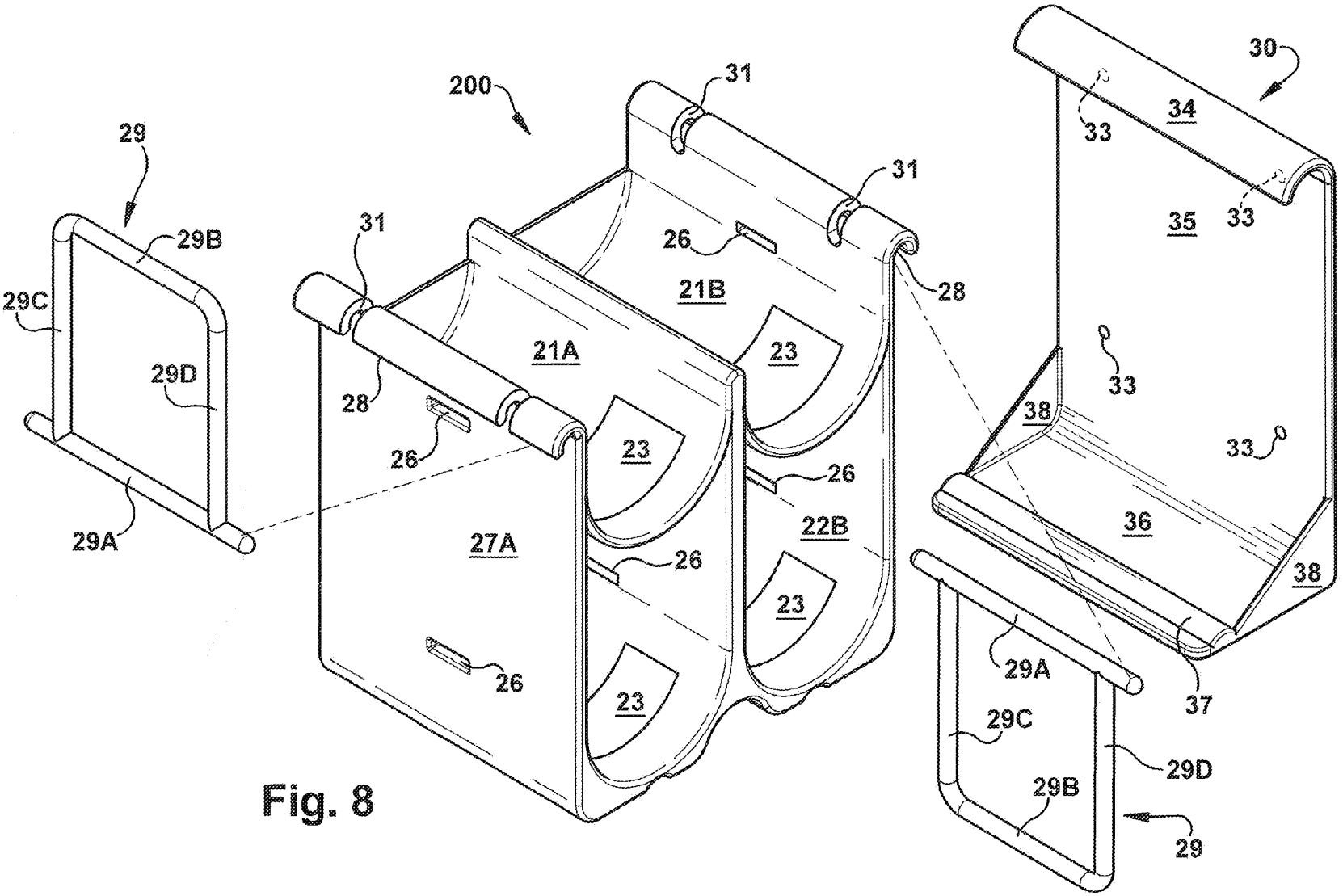
FIG. 8 is an exploded view of the portable wine rack of FIG. 5.
Figure 10:
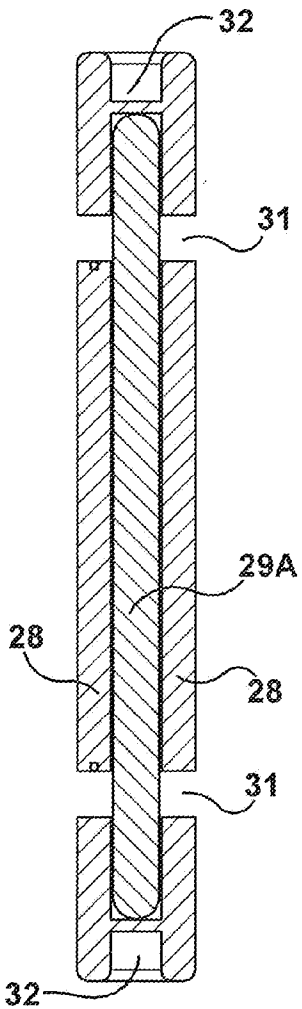
FIG. 10 is a front view of FIG. 9 from the perspective of arrows 6-6.
Figure 9:
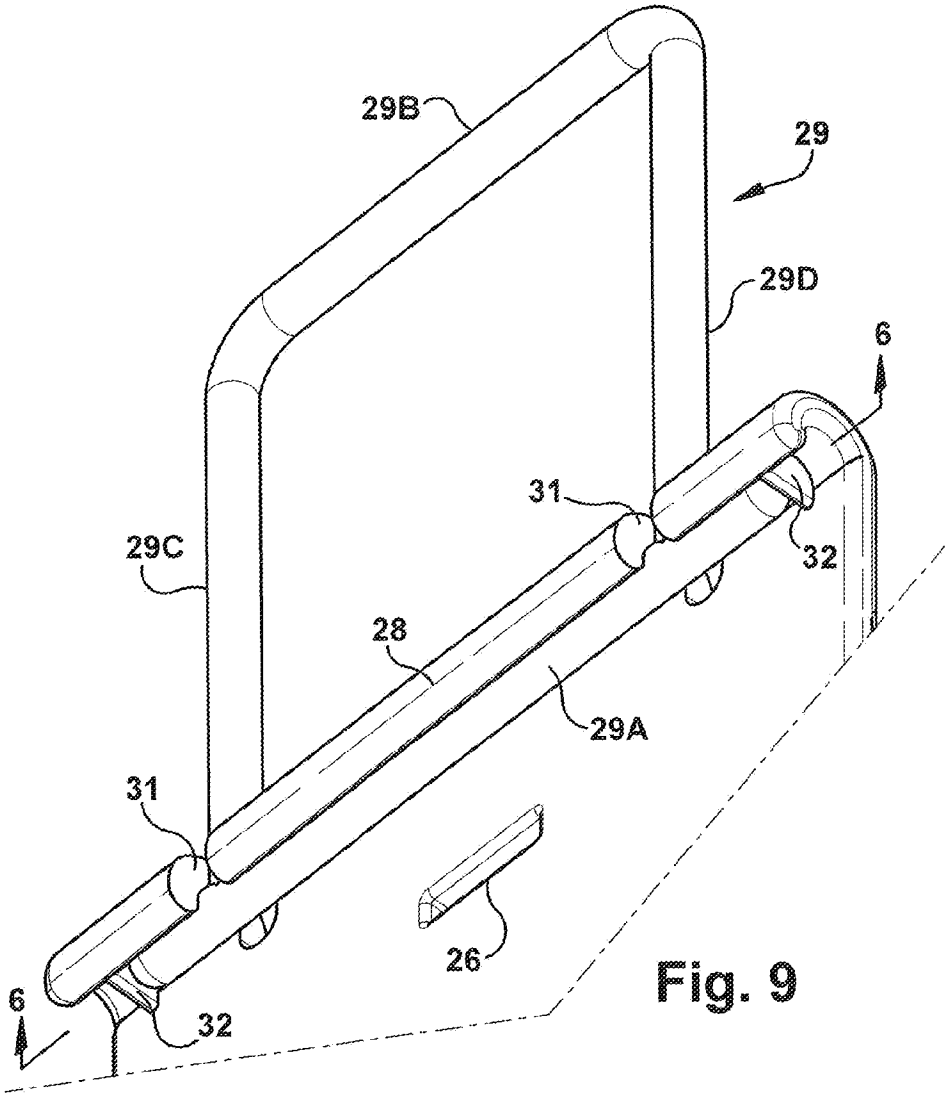
FIG. 9 is a perspective close-up view of one side of the portable wine rack where the handle is attached.

An alternate embodiment of the portable wine rack of the present disclosure and related inventions is shown in FIGS. 5-10. In a preferred embodiment, this rack is made of extruded plastic, but may be alternatively made of wood, metal, or any other suitable material. In this embodiment, the rack 200 contains the same type of u-shaped channels 21A, 21B, 22A, 22B arranged in two tiers, an upper and a lower tier, as described above with respect to the other embodiments. In a preferred embodiment, the wine rack can accommodate up to four bottles, two bottles located in an adjacent manner on a first tier and two bottles located in an adjacent manner on a second tier. The second tier is vertically spaced apart from and located directly above the first tier. Each tier contains two u-shaped channels 21A, 21B, 21C, 21D which each hold or cradle a single bottle placed on its side in a horizontal manner. The two u-shaped channels 21A, 21B on the first or bottom tier contain side walls that extend vertically upward and are contiguous with the two u-shaped channels 22A, 22B on the second or top tier. The two u-shaped channels 22A, 22B on the second or top tier continue to extend vertically upward, reaching a point above the top of a horizontally placed bottle as placed within one of the channels 22A, 22B. Each of the u-shaped channels 21A, 22A, 21B, 22B, contains a back or rear face 40 which is a half-circle-shaped substantially planar panel for securing a bottle within the channel, with the bottom of a bottle placed adjacent to (or abutting against) the rear or back face 40 of the channel 21A, 22B, 21B, 22B. The front face of each channel is open for insertion of bottles therein. The right 27B and left 27A side walls of the rack 200 are substantially planar, but may contain slots or openings thereon. The upper edge of the right 27B and left 27A side walls of this rack 200 each contain a curved lip which extends up and outward, away from the rack 200, and curves slightly downward, thereby creating an inverted u-shaped channel 28 (hereinafter referred to as "inverted u-shaped channel"; "inverted channel"; "channel" or "u-shaped channel"). The rounded upper surface of the lip also contain two notches or openings 31 therein which facilitate the movement of a handle 29 therein. One handle 29 is inserted into each of the two channels 28, as shown in FIG. 9. The handles 29, in a preferred embodiment, are substantially square-shaped having two opposed vertical sides 29C, 29D connected by two opposed horizontal sides 29A, 29B. One of the horizontal sides 29A, is longer than the other horizontal and vertical sides (hereinafter referred to as the "long edge" of the handle). This long edge 29A of the handle 29 is the portion of the handle 29 which gets inserted into the inverted u-shaped channels 28 on the right 27B and left 27A side walls of the rack 200. The opening of each inverted u-shaped channel 28 is slightly smaller than the width or thickness of the long edge 29A of the handle 29, such that the handle 29 can snap into place inside the channel 28 by applying an upward force thereto. No additional hardware is needed to attach each handle 29 to the rack 200. Once the handle 29 has been snapped into the channel 28, the slightly smaller size of the channel opening keeps the handle 29 in place inside the channel 28 while the handle 29 can move or partially pivot about the channel 28. Also, two small caps or stops 32 are located at opposing ends of each inverted channel 28 to prevent horizontal or lateral movement of the handle 29 once it has been snapped into the channel 28, as shown in FIGS. 6, 9 and 10. Each channel 28 also contains two notches or openings 31 thereon which facilitate the movement of the handle 29 about the channel 28 and the rack 200. The notches 31 allow the handles 29 to move from a first position, wherein the handle 29 is positioned vertically in the channel 28 and adjacent to the right 27B and left 27A side walls of the rack 200 to within approximately 270-degrees of the first position. The long edge 29A of the handle 29 can easily move or rotate within the channel 28 allowing the opposing horizontal side of the handle 29B (hereinafter referred to as the "gripping portion") to be used to grip and carry or transport the rack 200. The two opposing handles 29 may each come together in an A-shape where the tops or the gripping portion 29B of each handle 29 are in contact with one another such that the rack 200 may easily be carried in one hand by a user. The simple nature of the handle attachment allows the handle 29 to easily be swung or pivoted upward when a user is ready to carry or transport the wine rack 200 and also easily placed back down at the sides of the rack 200, where they are neatly positioned at the outer side walls of the rack 200. As described above with respect to one of the alternate embodiments, this embodiment also contains a band or strip of material 25 which extends across each tier above the bottles placed in the u-shaped channels 21A, 21B, 22A, 22B, the material 25 having a reinforced loop patch (such as a Velcro™ loop patch) sewn or otherwise attached to the bottom or downward facing surface 25B thereof. The material 25 may extend from the right side 27B to the left side 27A of the rack 200 and beyond. A small hook patch (such as a Velcro™ hook patch) 24 may be attached, adhesively or otherwise, to the outer surface of the right 27B and left 27A sides of the rack 200. At least one band or strip of material 25 with the loop patch extends across each tier with each of the distal ends inserted into openings 26 on the right 27B and left 27A side walls of the rack 200 and attached to the hook patch 24 such that the band or strip of material 25 is held taut across the top surface of any bottles lying horizontally within each u-shaped channel 21A, 21B, 22A, 22B, as shown in FIG. 5. The bottom surface of the wine rack 200 contains at least one, but preferably two upward, arced cut-outs 39, which facilitate attachment of the wine rack 200 to a wall-mounted base unit 30, as described in further detail below.

Similar to the other embodiments described above, the wine rack of this embodiment can be inserted into a wall-mount unit 30. The wall-mount unit 30 (hereinafter referred to as "wall mount unit"; "wall mount base"; "unit"; "base unit" or "base") contains two openings (less than or greater than two openings can be used as well) thereon 33 which can be utilized to attach the unit 30 to a wall of a boat, an RV or other moving vehicle or vertical substrate. The openings 33 may accommodate screws or other such attachment hardware used to secure the base 30 to a vertical substrate. The wall-mount unit 30 contains a vertical wall 35 which has a curved upper lip 34 which creates an inverted u-shaped channel similar to that contained on the right 27B and left 27A side walls of the portable wine rack 200. The opposite or bottom edge of the vertical wall 35 contains a horizontal floor 36 which extends outward from the vertical wall 35. The horizontal floor 36 contains an upward extending bump or ridge 37 thereon which is used to facilitate securement of the portable wine rack 200 to the base unit 30. Two triangular side panels 38 are attached to the opposing sides of the horizontal floor 36 portion of the base 30 to facilitate lateral securement of the portable wine rack 200 to the base unit 30.

To attach and secure the wine rack 200 to the wall-mount base unit 30, the wine rack 200 simply snaps into place within the base unit 30. The curved upper edges of the wine rack (which create the inverted u-shaped channels 28) are inserted beneath the curved upper lip 34 of the base unit 30 and the one or more upwardly arced cut-out 39 on the wine rack 300 corresponds to and fits over the upwardly extending bump or ridge 37 on the base unit 30. Preferably, the wine rack contains two upwardly arced cut-outs 39 which are placed at an equal distance from each of the opposing outer edges of the wine rack 200, so that either side 27A, 27B of the wine rack 200 can be inserted into the wall-mount base unit 30.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, and expected variations and modifications of the examples are clearly within the scope of the invention where the invention is limited solely by the scope of the following claims.

What is claimed is:

1. A portable bottle rack comprising:

a right side wall opposite and spaced apart from a left side wall;

at least two channels contained between the right and left side walls, each of the at least two channels operable to accommodate a single bottle therein;

a handle attached to each of the right and left side walls which are partially pivotable thereabout;

at least one securement strap which is removably attached to the right and left side walls and which extends across the at least two channels;

wherein the at least two channels are positioned adjacent to one another.

2. The portable bottle rack of claim 1, wherein a bottle placed into one of the at least two channels must be placed on its side or horizontally within the channel.

3. The portable bottle rack of claim 1, wherein an inside surface of the at least two channels contains a gripping material.

4. The portable bottle rack of claim 1, wherein the portable bottle rack is operable to be removably attached to a wall-mount base unit.

5. The portable bottle rack of claim 4, wherein the wall-mount base unit is operative to be removably secured to a vertical surface.

6. The portable bottle rack of claim 1, wherein the at least one securement strap contains a fabric loop patch material which attaches at one end to a fabric hook patch material contained on the right side wall and at an opposite end to a fabric hook patch material contained on the left side wall.

7. The portable bottle rack of claim 1, wherein each handle is contained within an inverted u-shaped channel which is contiguous with the right and left side walls.

8. The portable bottle rack of claim 1, wherein the at least one securement strap comes into direct contact with a bottle placed into one of the at least two channels.

9. A portable bottle rack comprising:

a right side wall opposite and spaced apart from a left side wall;

at least two channels contained between the right and left side walls, each of the at least two channels operable to accommodate a single bottle therein;

a handle attached to each of the right and left side walls which are partially pivotable thereabout;

at least one securement strap which is removably attached to the right and left side walls and which extends across the at least two channels;

wherein one of the at least two channels is positioned above the other of the at least two channels.

10. The portable bottle rack of claim 9, wherein a bottle placed into one of the at least two channels must be placed on its side or horizontally within the channel.

11. The portable bottle rack of claim 9, wherein an inside surface of the at least two channels contains a gripping material.

12. The portable bottle rack of claim 9, wherein the portable bottle rack is operable to be removably attached to a wall-mount base unit.

13. The portable bottle rack of claim 12, wherein the wall-mount base unit is operative to be removably secured to a vertical surface.

14. The portable bottle rack of claim 9, wherein the at least one securement strap contains a fabric loop patch material which attaches at one end to a fabric hook patch material contained on the right side wall and at an opposite end to a fabric hook patch material contained on the left side wall.

15. The portable bottle rack of claim 9, wherein a first securement strap extends across one of the at least two channels and a second securement strap extends across the other of the at least two channels.

16. A portable bottle rack comprising:

a right side wall opposite and spaced apart from a left side wall;

at least two channels contained between the right and left side walls, each of the at least two channels operable to accommodate a single bottle therein;

a handle attached to each of the right and left side walls which are partially pivotable thereabout;

at least one securement strap which is removably attached to the right and left side walls and which extends across the at least two channels;

wherein the portable bottle rack is operable to be removably attached to a wall-mount base unit; and wherein the wall-mount base unit is operative to be removably secured to a vertical surface.

17. The portable bottle rack of claim 16, wherein a bottle placed into one of the at least two channels must be placed on its side or horizontally within the channel.

18. The portable bottle rack of claim 16, wherein an inside surface of the at least two channels contains a gripping material.

19. The portable bottle rack of claim 16, wherein each handle is contained within an inverted u-shaped channel which is contiguous with the right and left side walls.

20. The portable bottle rack of claim 16, wherein the at least one securement strap contains a fabric loop patch material which attaches at one end to a fabric hook patch material contained on the right side wall and at an opposite end to a fabric hook patch material contained on the left side wall.

* * * * *